US005265982A

United States Patent [19]

Burtelson

[11] Patent Number: 5,265,982

[45] Date of Patent: Nov. 30, 1993

[54] HIGH STRENGTH ANCHOR

[75] Inventor: Frederick W. Burtelson, Harvard, Ill.

[73] Assignee: Joslyn Manufacturing Corporation, Chicago, Ill.

[21] Appl. No.: 973,081

[22] Filed: Nov. 6, 1992

[51] Int. Cl.[5] ..... E02D 5/80

[52] U.S. Cl. ..... 405/303; 52/157; 405/259.1

[58] Field of Search ..... 405/259.1, 303; 52/157; 175/400, 388, 394

[56] References Cited

U.S. PATENT DOCUMENTS

| | | | |
|---|---|---|---|
| 3,828,562 | 8/1974 | Petres . | |
| 4,334,392 | 6/1982 | Dziedzic | 52/157 |
| 4,467,575 | 8/1984 | Dziedzic | 52/157 |
| 4,742,656 | 5/1988 | Farmer | 52/155 |
| 4,979,341 | 12/1990 | Norman et al. | 52/157 |
| 4,981,000 | 1/1991 | Hamilton et al. | 52/157 |
| 4,996,806 | 3/1991 | Platz | 52/157 |

*Primary Examiner*—Dennis L. Taylor

*Attorney, Agent, or Firm*—Marshall, O'Toole, Gerstein, Murray & Borun

[57] ABSTRACT

The disclosed earth anchor has a helix formed in a spiral around a hub. The helix is arranged to bear a load when the earth anchor is installed into the earth. The hub has outer and central hub portions forming a recess which receives a torque tube having inner and outer perimeters. Torque is transferred from the outer perimeter of the torque tube through the outer hub portion of the hub to the helix and from the inner perimeter of the torque tube through the central hub portion of the hub to the helix. The hub is of a unitary construction.

22 Claims, 4 Drawing Sheets

HIGH STRENGTH ANCHOR

TECHNICAL FIELD OF THE INVENTION

The present invention relates generally to earth anchors and, more particularly, to an earth anchor having a helix formed around a hub wherein the hub is arranged to transfer a greater range of torque from a torque tube to the helix.

BACKGROUND OF THE INVENTION

Anchors installed in soil (hereinafter referred to as "earth anchors") are commonly utilized to provide support, either in tension or in compression, for electrical or mechanical hardware or equipment. For example, earth anchors are commonly utilized to provide anchorage, in tension, for guy lines used to support electrical transmission, distribution and communication equipment. Earth anchors are also used to provide support, in compression, for electrical and mechanical equipment such as street lighting poles, pipelines, and other similar equipment.

Earth anchors typically include a helix formed in a spiral configuration around a hub. When the earth anchor is to be installed into the earth, a torque tube is coupled to the hub of the earth anchor so that the torque applied to the torque tube is transferred through the hub from the torque tube to the helix. The torque tube is controlled to then apply both a downward force and a rotational force to the earth anchor. The combination of the downward and rotational forces causes the helix to bore into the earth.

The size and weight of the equipment supported by an installed earth anchor determine the load on that earth anchor. Since it is primarily the helix of the earth anchor which absorbs the load exerted on the earth anchor, the diameter of the helix must be designed to withstand its expected load. The compaction of the earth into which the earth anchor is installed also determines the diameter of the helix. That is, for a given load, the diameter of a helix can be made smaller for soils which are more compact. Furthermore, the size of the helix and the compaction of the soil into which the earth anchor is installed determine the amount of torque required to install the earth anchor. Since it is the function of the hub to transfer torque from the torque tube to the helix during installation of the earth anchor, it is the size and weight of the hub which determine the amount of the torque which can be applied to the hub and transferred from the torque tube to the helix.

Because the equipment supported by earth anchors varies in size and weight, and because the compaction of the earth varies from location to location, the helices of earth anchors have been historically provided in a variety of sizes and weights. Because the helices of earth anchors are provided in a variety of sizes and weights, and because the compaction of the earth varies from location to location, the hubs of earth anchors have also been historically provided in a variety of sizes and weights.

For example, an earth anchor requiring 8,000 foot pounds of torque to install the earth anchor into the earth was provided with a 1½ inch square hub whereas an earth anchor requiring 12,000 foot pounds of torque was provided with a 2 inch square hub. A hub having a standard, intermediate size and weight but which can be used over a wide range of torques results in cost savings due both to this standardization of hubs and to the elimination of the higher cost, more massive hubs which were heretofore used in the upper portion of this torque range.

SUMMARY OF THE INVENTION

The hub of the present invention achieves these cost savings by permitting a greater torque to be transferred from a torque tube to a helix without a concomitant increase in the size and weight of the hub. Thus, the earth anchor according to one aspect of the present invention includes an earth penetrating means for penetrating the earth during installation of the earth anchor and a torque transferring means for transferring torque from a torque tube to the earth penetrating means. The earth penetrating means is arranged to bear a load when the earth anchor is installed in the earth. The torque transferring means is arranged to receive a torque tube having an inner perimeter and an outer perimeter and to transfer torque from both the inner and outer perimeters of the torque tube to the earth penetrating means.

In another aspect of the invention, the earth anchor includes a hub and a load-bearing, earth penetrating helix. The helix is arranged in a spiral around the hub. The hub is of unitary construction and has first and second ends. The first end of the hub has first and second walls forming a recess therebetween. The recess is arranged to receive a torque tube. The first and second walls are arranged so that both the first and second walls receive torque from the torque tube when the torque tube drives the earth anchor into the earth.

An earth anchor according to yet a further aspect of the invention includes a load-bearing, earth penetrating helix arranged in a spiral around a hub. The hub has a unitary construction and first and second polygonal walls forming a polygonal recess therebetween. The polygonal recess is arranged to receive a polygonal torque tube having a first polygonal shape substantially commensurate with the first polygonal wall and a second polygonal shape substantially commensurate with the second polygonal wall. Both the first polygonal wall and the second polygonal wall of the hub are arranged to receive torque from the polygonal torque tube and to transfer that torque to the load-bearing, earth penetrating helix.

BRIEF DESCRIPTION OF THE DRAWINGS

These and other features and advantages will become more apparent from a detailed consideration of the invention when taken in conjunction with the drawing in which.

DETAILED DESCRIPTION

Figure 1:
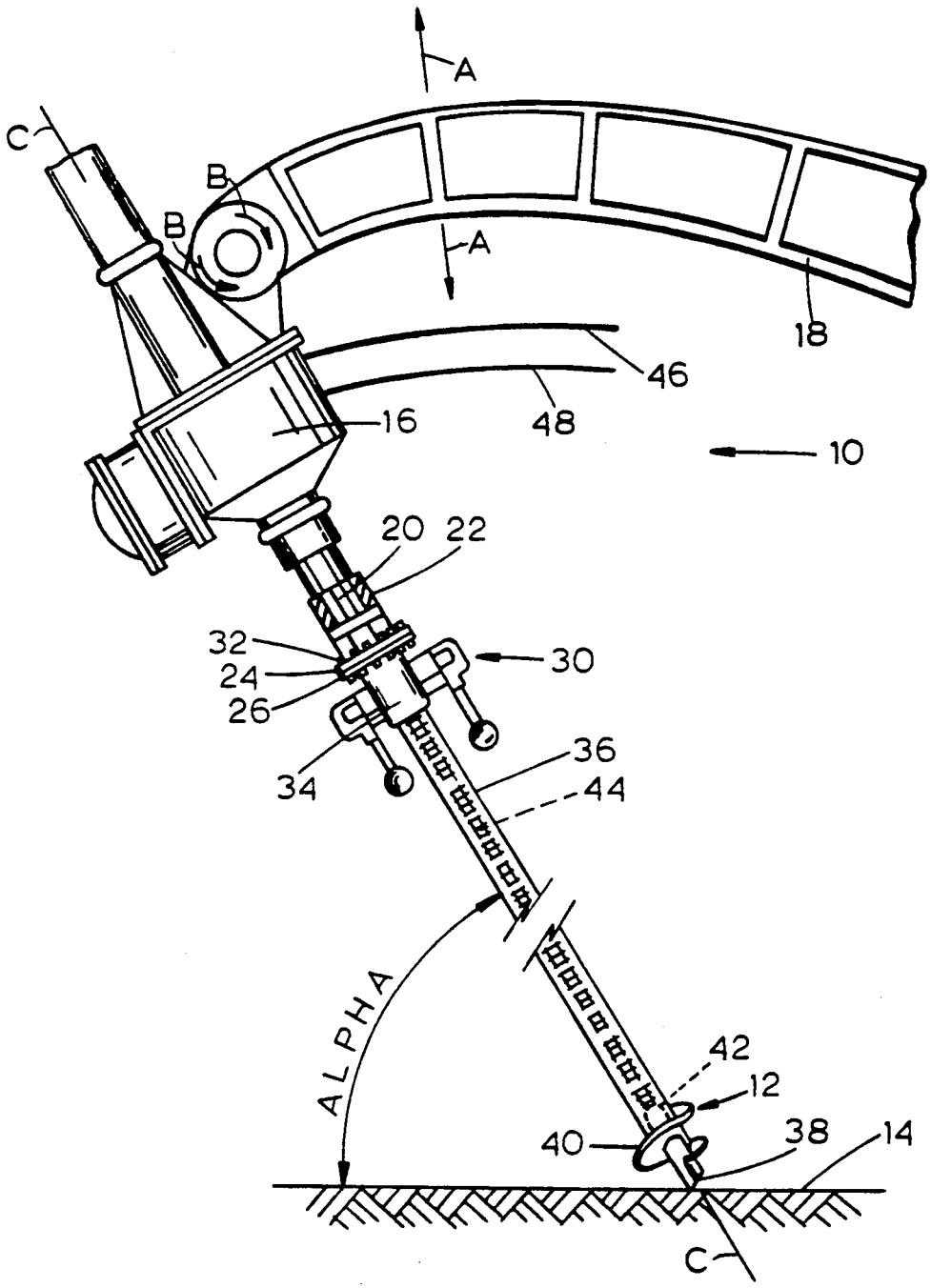
FIG. 1 is an elevational view of an apparatus for installing an earth anchor into soil.

Illustrated in FIG. 1 is an apparatus 10 for installing earth anchors into soil. The apparatus 10 is more fully described in U.S. Pat. No. 4,580,795 the disclosure of which is incorporated herein by reference. The apparatus 10 is adapted to rapidly and safely install a prior art earth anchor 12 into soil 14 using axial thrust and rotational power from a mechanical power source 16 such as a hydraulically, pneumatically, or electrically powered torque motor which is carried on a supporting boom or arm 18 of a movable vehicle (not shown). The arm 18 is pivotable up and down (as indicated by directional arrows "A") to position the motor 16 at an appropriate level above the surface of the soil 14. The motor 16 is pivotally secured adjacent the outer end of the boom 18 so that a drive axis of the motor may be pivoted as desired (as indicated by directional arrows "B") to provide a selected angle "ALPHA" between a longitudinal drive axis or center line "C—C" and a horizontal level as needed for a particular installation of an earth anchor. The motor 16 includes an output shaft or Kelly Bar 20 having a polygonal-shaped transverse cross-section and being coaxially aligned along the drive axis "C—C". The Kelly bar 20 supports an adapter sleeve 22 having a lower, radial flange 24 which is secured to an upper flange 26 of a torque tube and earth anchor drive coupling assembly 30. The flanges 24 and 26 are secured together by a plurality of bolt and nut assemblies 32 which are spaced at intervals circumferentially around the drive axis "C—C" adjacent to an outer rim of the adjoining flanges 24 and 26.

The drive coupling assembly 30 includes a body portion 34 depending downwardly from the radial flange 26 at the upper end. The body portion 34 includes an inwardly extending internal socket (not shown) which receives one end of an elongated hollow torque tube 36 having a transverse cross-sectional dimension to fit smoothly within the internal socket. The drive coupling assembly 30 is also arranged, as described in the aforementioned U.S. Pat. No. 4,580,795 to retain one end of an anchor rod 44 suitably attached to the earth anchor 12.

Figure 2:
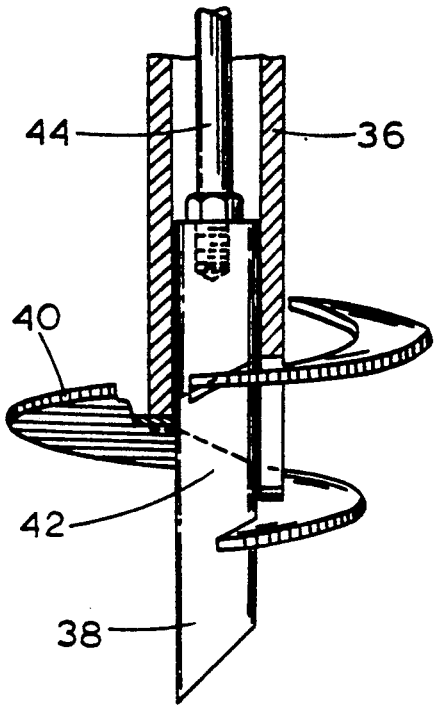
FIG. 2 is a partial cross-sectional diagram showing the attachment of an anchor rod to an earth anchor according to the prior art.

The earth anchor 12 has a point 38 of polygonal-shaped transverse cross-section and a helical screw flight 40 for boring into the surface of the soil 14. The helical screw flight or helix 40 is suitably attached, as by welding, to a hub 42. At one end of the hub 42 is the point 38, and at the other end of the hub 42 is an internally threaded bore. As shown in FIG. 2, one end of an anchor rod 44 is threaded into this internally threaded bore of the hub 42, and the other end of the anchor rod 44 is held by the drive coupling assembly 30. Thus, the torque tube 36 and the earth anchor 12 are drivingly attached to the drive coupling assembly 30. Accordingly, torque applied to the torque tube 36 by the motor 16 is transferred through the hub 42 to the helix 40 of the earth anchor 12.

The motor 16 is provided with hydraulic fluid, pneumatic fluid (e.g. air), or electrical power through a supply line 46 and a return line 48. During installation of the earth anchor 12 into the soil 14, the boom 18 applies axial pressure to the earth anchor 12. At the same time, the motor 16 receives power by way of the lines 46 and 48 to rotate the earth anchor 12 through the torque tube 36 in order to rotate the screw flight 40 to power the earth anchor 12 into the soil 14. As shown in FIG. 2, torque is transferred from the torque tube 36 to the helix 40 only through the inner perimeter of the torque tube 36 and the outer perimeter of the hub 42.

The earth anchor 50 according to the present invention is shown in FIGS. 3–8. The earth anchor 50 has a helix 52 attached, as by welding, to a hub 54. The earth anchor 50 is arranged so that torque may be transferred from a torque tube to the helix 52 not only by the inner perimeter of the torque tube to the hub 54 but also by the outer perimeter of the torque tube to the hub 54. Thus, a greater torque may be transferred to the helix 52 without increasing the size and weight of the hub 54.

Figure 3:
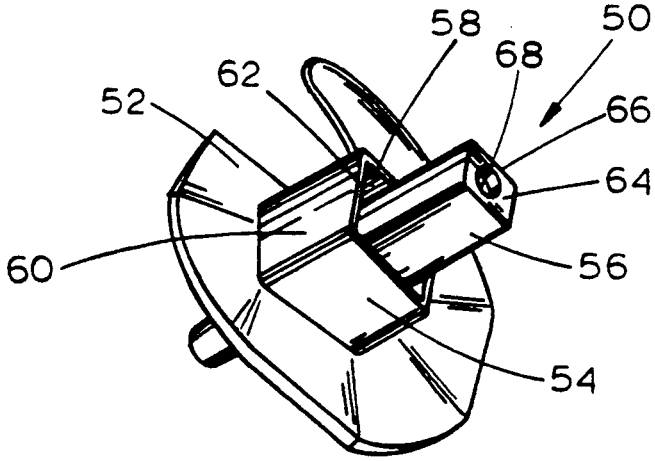
FIG. 3 is a side perspective view of an earth anchor according to the present invention.
Figure 7:
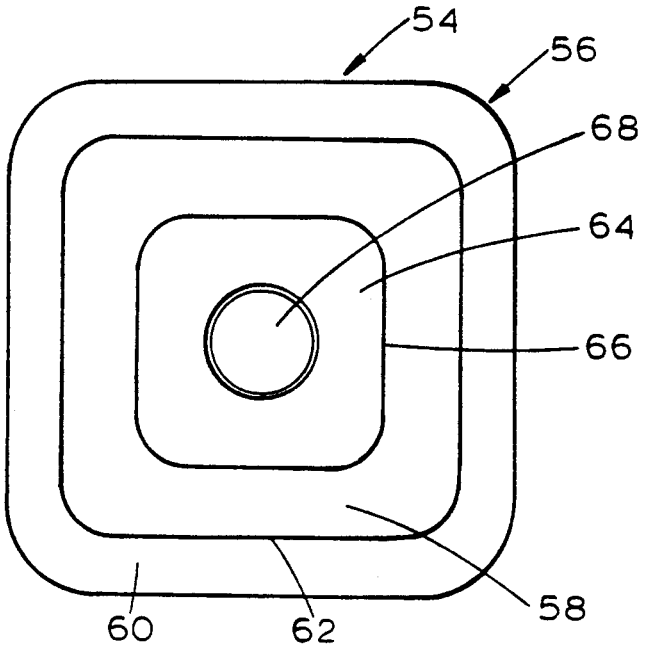
FIG. 7 is a top view of the hub of FIG.

Accordingly, as shown in FIGS. 3 and 7, one end 56 of the hub 54 has a recess 58 formed between an outer hub portion or wall 60, which has an inner perimeter 62 substantially in the form of a polygon, and a central hub portion or wall 64, which has an outer perimeter 66 also substantially in the form of a polygon. Specifically, as shown, the inner perimeter 62 of the outer hub portion 60 and the outer perimeter 66 of the central hub portion 64 are substantially square although any other generally rectangular shape is possible. Furthermore, although a rectangular shape is preferable, any perimeter shape is possible as long as substantial torque is transferred through both the outer hub portion 60 and the central hub portion 64 to the helix 52. Additionally, the outer hub portion 60 and the central hub portion 64 are shown as conveniently, but not necessarily, having the same polygonal shape.

Figure 4:
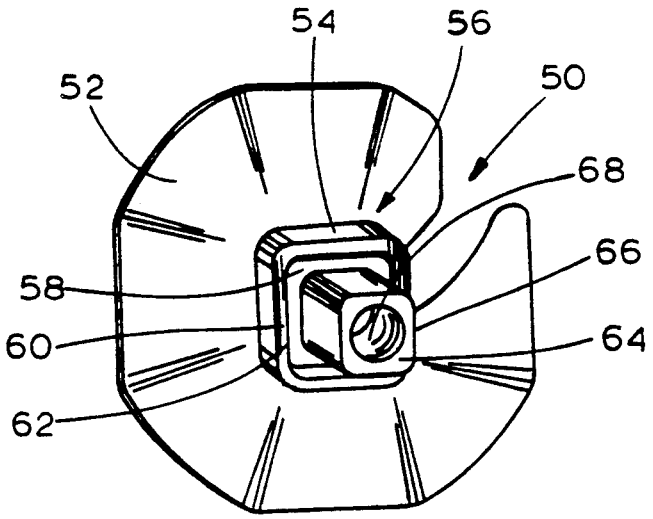
FIG. 4 is a top perspective view of the earth anchor according to the present invention.
Figure 5:
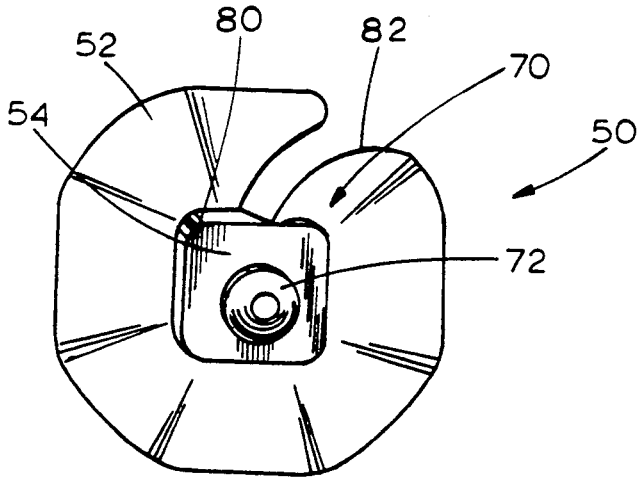
FIG. 5 is a bottom perspective view of an earth anchor according to the present invention.

As better shown in FIGS. 3–5, an internally threaded hole or bore 68 may be provided in the central hub portion 64 for threadably receiving an anchor rod in order to couple the earth anchor 50 to a torque tube and to a drive coupling assembly in a fashion similar to that shown in FIG. 1.

Figure 6:
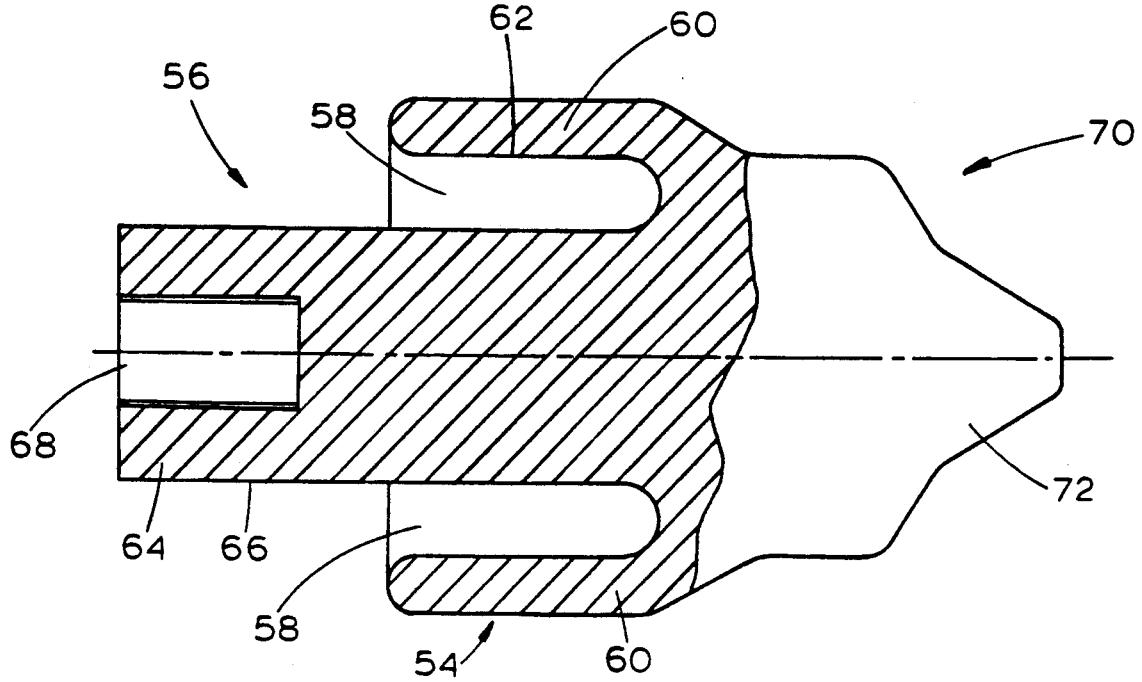
FIG. 6 is a partial cross-sectional diagram of the hub of the earth anchor according to the present invention.

As shown in FIGS. 5 and 6, the hub 54 of the earth anchor 50 has a second end 70 with a circular point 72. When the earth anchor 50 is axially driven toward the soil, the point 72 of the hub 54 is arranged to first penetrate the soil.

Figure 8:
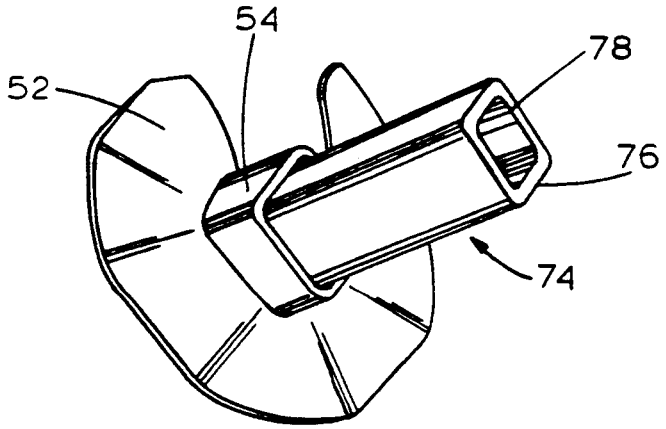
FIG. 8 is a perspective view showing the combination of an earth anchor and the lower portion of a torque tube.

As shown in FIG. 8, the lower end 74 of a hollow torque tube has an outer perimeter 76 which is substantially commensurate with the inner perimeter 62 of the outer hub portion 60, and an inner perimeter 78 which is substantially commensurate with the outer perimeter 66 of the central hub portion 64 of the hub 54. Thus, the end 74 of the torque tube fits snugly within the recess 58 between the outer hub portion 60 and the central hub portion 64. Torque is accordingly transferred from the lower end 74 of the torque tube to both the outer hub portion 60 and the central hub portion 64 of the hub 54.

Furthermore, the hub 54 having the recess 58 formed by the outer hub portion 60 and the central hub portion 64 is of a unitary construction and may be constructed as by forging or any other suitable process. The anchor flight 52 can be welded to the hub 54 or it can be forged along with the hub 54 so that the hub 54, with its outer hub portion 60 and its central hub portion 64, together with the helix 52 may be of unitary construction.

By transferring torque from the torque tube 74 to both the outer hub portion 60 and the central hub portion 64 of the hub 54, the torque range of the earth anchor 50 can be increased without increasing the size and weight of the hub 54. By increasing the torque range of the hub 54 without increasing the size and weight of the hub 54, cost savings can be realized because inventories of hubs can be standardized and because the larger, more expensive hubs can be eliminated. Furthermore, the unitary construction of the hub 54 reduces its manufacturing costs.

As shown in FIG. 5, a lower corner 80 of the hub 54 is arranged to sweep the soil ahead of the leading edge 82 of the helix 52 as the anchor 50 is rotated by the torque tube during installation of the anchor 50 into the soil. Accordingly, this sweeping action of the corner 80 of the hub 54 breaks up the soil ahead of the leading edge 82 thus prolonging the life of the helix 52.

Modifications to the structure of the earth anchor disclosed herein may be made without departing from the scope of the present invention as will be readily apparent to those skilled in the art. Such modifications are encompassed within the scope of the present invention and the present invention is only to be limited by the claims herein.

I claim:

1. An earth anchor comprising:

earth penetrating means for penetrating the earth during installation of the earth anchor, the earth penetrating means including a helix, the helix being arranged to bear a load when the earth anchor is installed in the earth; and, torque transferring means for transferring torque from a torque tube to the helix, the torque transferring means being arranged to receive a torque tube having an inner perimeter and an outer perimeter and to transfer torque from both the inner and outer perimeters of the torque tube to the helix.

2. The earth anchor of claim 1 wherein the torque transferring means comprises a hub having a central hub portion and an outer hub portion defining a recess, the recess being arranged to receive a torque tube, and both the central and outer hub portions being arranged to receive torque from the torque tube and to transfer that torque to the helix during installation of the earth anchor.

3. The earth anchor of claim 2 wherein the hub having the central and outer hub portions is of unitary construction.

4. The earth anchor of claim 3 wherein the helix is arranged in a spiral around the outer hub portion.

5. The earth anchor of claim 4 wherein the central hub portion has a generally rectangular outer perimeter and wherein the outer hub portion has a generally rectangular inner perimeter, the outer perimeter of the central hub portion and the inner perimeter of the outer hub portion being arranged to engage a torque tube so that torque is transferred from the torque tube to the helix by both the central and outer hub portions of the hub.

6. The earth anchor of claim 5 wherein the central hub portion is threaded to threadably engage an anchor rod.

7. The earth anchor of claim 6 wherein the helix is welded to the outer hub portion.

8. The earth anchor of claim 1 wherein the torque transferring means is of unitary construction.

9. The earth anchor of claim 8 wherein the helix is arranged in a spiral around the torque transferring means.

10. The earth anchor of claim 9 wherein the torque transferring means has a generally rectangular recess being arranged to receive the torque tube.

11. The earth anchor of claim 10 wherein the torque transferring means is threaded to threadably engage an anchor rod.

12. The earth anchor of claim 11 wherein the helix is welded to the torque transferring means.

13. The earth anchor of claim 1 wherein the helix is arranged in a spiral around the torque transferring means.

14. The earth anchor of claim i wherein torque transferring means has a generally rectangular recess arranged to receive the torque tube.

15. An earth anchor comprising:

a hub having first and second ends and being of unitary construction, the first end of the hub having a recess formed between first and second walls, the recess being arranged to receive a torque tube and the first and second walls being arranged so that both the first and second walls receive torque from the torque tube when the torque tube drives the earth anchor into earth; and, a load-bearing and earth penetrating helix arranged in a spiral around the hub between the first and second ends.

16. The earth anchor of claim 15 wherein the first and second walls are arranged to transfer the torque received from the torque tube to the load-bearing and earth penetrating helix during installation of the earth anchor.

17. The earth anchor of claim 16 wherein the first and second walls are generally rectangular.

18. The earth anchor of claim 17 wherein the hub is threaded to threadably engage an anchor rod.

19. The earth anchor of claim 18 wherein the load-bearing and earth penetrating helix is welded to the hub.

20. The earth anchor of claim 15 wherein the first and second walls are generally rectangular and are arranged to engage a torque tube so that torque is transferred by both the first and second walls from the torque tube to the load-bearing and earth penetrating helix.

21. The earth anchor of claim 15 wherein the load-bearing and earth penetrating helix is welded to the hub.

22. An earth anchor comprising a load-bearing and earth penetrating helix arranged in a spiral around a hub, the hub being of unitary construction, the hub having a polygonal recess formed between a first polygonal wall and a second polygonal wall, the polygonal recess being arranged to receive a torque tube having a first polygonal shape substantially commensurate with the first polygonal wall and a second polygonal shape substantially commensurate with the second polygonal wall, wherein the first polygonal wall and the second polygonal wall are arranged to receive torque from the torque tube and to transfer that torque to the load-bearing and earth penetrating helix.

* * * * *

UNITED STATES PATENT AND TRADEMARK OFFICE

CERTIFICATE OF CORRECTION

PATENT NO. : 5,265,982

DATED : November 30, 1993

INVENTOR(S) : Frederick W. Burtelson

It is certified that error appears in the above-indentified patent and that said Letters Patent is hereby corrected as shown below:

Col. 2, line 65, "FIG. and," should be --FIG. 6; and,--.

Col. 6, line 15, "claim i" should be --claim 1--.

Signed and Sealed this

Tenth Day of May, 1994

Bruce Lehman

*Attest:*

BRUCE LEHMAN

*Attesting Officer*

*Commissioner of Patents and Trademarks*